US005604323A

United States Patent [19]

Hardie-Bick

[11] Patent Number: 5,604,323

[45] Date of Patent: Feb. 18, 1997

[54] MUSICAL TONE ELECTRONIC SYNTHESIZER AND METHOD

[75] Inventor: Anthony R. Hardie-Bick, London, Great Britain

[73] Assignee: Ethymonics Limited, Kent, Great Britain

[21] Appl. No.: 300,991

[22] Filed: Sep. 6, 1994

[30] Foreign Application Priority Data

Sep. 7, 1993 [GB] United Kingdom ..... 9318524

[51] Int. Cl.[6] ..... G10H 7/00

[52] U.S. Cl. ..... 84/604; 84/624; 84/625

[58] Field of Search ..... 84/600, 601, 604, 84/605, 607, 624, 625, 622, 660

[56] References Cited

U.S. PATENT DOCUMENTS 4,036,096 7/1977 Tomisawa et al. ..... 84/607
4,246,823 1/1981 Wachi et al. .
4,249,447 2/1981 Tomisawa ..... 84/624 X
4,444,082 4/1984 Whitefield ..... 84/621 X
4,602,545 7/1986 Starkey .
4,719,833 1/1988 Katoh et al. ..... 84/604 X
4,875,400 10/1989 Okuda et al. ..... 84/626
5,252,773 10/1993 Kozuki et al. ..... 84/661 X

*Primary Examiner*—William M. Shoop, Jr.
*Assistant Examiner*—Jeffrey W. Donels
*Attorney, Agent, or Firm*—Antonelli, Terry, Stout & Kraus, LLP

[57] ABSTRACT

A tone generator (501) for a musical synthesizer has digital waveform generators (602,603) arranged such that a proportion of an output from a waveform generator (602) is supplied to a phase modulating input of a next waveform generator (603), wherein a proportion of the output from the last waveform generator in a chain (603) of serially connected waveform generators is supplied to a phase modulating input of the first waveform generator (602) in said chain, thereby providing a degree of recursion. Outputs from a plurality of waveform generators are supplied to a ring modulator (604) for generating harmonic sums and differences of frequencies produced by said recursion. A variable precision waveform lookup table (803) may be used to select a particular harmonic characteristic of tone and a frequency doubler (1001) may be included in the feedback loop to enable tones containing predominantly odd harmonics to be generated.

20 Claims, 14 Drawing Sheets

MUSICAL TONE ELECTRONIC SYNTHESIZER AND METHOD

FIELD OF THE INVENTION

The present invention relates to apparatus and methods for generating musical tones.

BACKGROUND OF THE INVENTION

The majority of contemporary electronic musical synthesizers use digital circuitry to generate tones in preference to analog circuitry, which was widely used until the early 1980's when digital techniques became economically feasible. Digital methods of tone generation have advantages of reduced cost, ease of manufacture and increased functionality, for example, the ability to synthesize the sounds of several different instruments simultaneously. A sequencer program may control a tone generator capable of producing the sounds of a drum kit, piano, strings and brass. Thus a musician may compose and preview complex arrangements without the delay and cost of using real musicians. Such facilities are a major reason for the widespread popularity of musical synthesizers which incorporate digital tone generators.

Unlike analogue electronic tone generators, most digital tone generators do not naturally produce sounds which are aesthetically appealing. The direct transposition of analog tone generator building-blocks, such as oscillators and filters, into the digital domain has proved unsuccessful. Thus digital tone generators largely exploit the ability to play back recordings of real musical instruments and passing such recordings or "samples" through filters and effects to enhance their appeal. The amount of memory required to store samples of a real instrument at the pitch of every note on a keyboard is excessively large, therefore a smaller number of samples are used, with a sample for a particular note speeded-up or slowed-down in order to simulate the sound of the instrument played at different pitches. An additional technique for saving sample memory is "looping", when a portion of the recorded sound is played back several times within the duration of a note. Sounds such as those of a string ensemble may particularly exploit this technique, as looping is less noticeable when employed in a sound of long duration and relatively constant amplitude.

Sampling is inherently limited by the ability of the human ear, especially the trained musical ear, to recognise the harmonic signatures of musical instruments. When a sample has been speeded-up, slowed-down or looped, the ear perceives resulting changes in pitch or distortion as unnatural, and may find the synthetic sound less appealing than the sound of a real instrument.

A further limitation of known sampling techniques is that variations in the tone produced is restricted by the amount of memory available for sound storage, such that it is impossible to store the entire range of tones produced by a real instrument, such as a saxophone. Dynamic changes in tone throughout the duration of a note can only be approximated very roughly by the application of synthetic filtering techniques.

In recognition of the restriction of existing digital musical instruments based on sampling, considerable research has been done in an attempt to mathematically model the physical processes that occur in a real musical instrument. Efficient mathematical models of physical processes can be used in algorithms for digital signal processors which can generate sounds in real time. If the physical processes of sound production are modelled in sufficient detail, it is possible to control aspects of the model to produce the same kind of changes in tone that may be produced on a real musical instrument. Furthermore, physical modelling can be used to define models of musical instruments which are physically impossible to build, and in this respect physical modelling may have considerable potential for the innovation of new sounds.

Physical modelling requires considerable digital signal processing circuitry in order to simulate the sound of a single note played on a real instrument. Thus electronic musical instruments based on physical modelling are very expensive and will remain so until digital signal processing becomes much cheaper. An additional problem with physical modelling is that defining the properties of a musical instrument in their entirety is beyond the ability of musicians who would use such an instrument. Thus analogue synthesizers, which may be controlled intuitively during a live musical performance, still retain a considerable advantage over the most recent generation of electronic synthesizers.

SUMMARY OF THE INVENTION

It is an object of the present invention to provide an improved apparatus and method for generating musical tones.

According to a first aspect of the present invention there is provided a method of electronically synthesizing musical tones, whereby a plurality of waveforms is generated using waveform generating units having respective inputs and outputs, such that each of said inputs are arranged to receive a signal for phase modulating the waveform generated by its respective waveform generating unit.

A proportion of an output from a first waveform generating unit is supplied to an input of a second waveform generating unit; a proportion of an output from said second waveform generating unit is supplied to an input of another waveform generating unit and so on in a chain, such that the input of said first waveform generating unit receives an output from the final waveform generating unit of said chain, thereby providing a degree of recursion.

A plurality of said outputs from said waveform generators are supplied to a processing means arranged to produce a tone including harmonic sums and differences of frequencies produced by said recursion.

According to a second aspect of the present invention, apparatus is provided comprising means for: generating a plurality of waveforms using waveform generating units having respective inputs and outputs, such that each of said inputs is arranged to receive a signal for phase modulating the waveform generated by its respective waveform generating unit; supplying a proportion of an output from a first waveform generating unit to an input of a second waveform generating unit; supplying a proportion of an output from said second waveform generating unit to an input of another waveform generating unit and so on in a chain, such that the input of said first waveform generating unit receives an output from the final waveform generating unit of said chain, thereby providing a degree of recursion; and supplying a plurality of said outputs to a processing means to produce a tone including harmonic sums and differences of frequencies produced by said recursion.

DETAILED DESCRIPTION OF THE PREFERRED EMBODIMENTS

Figure 1:
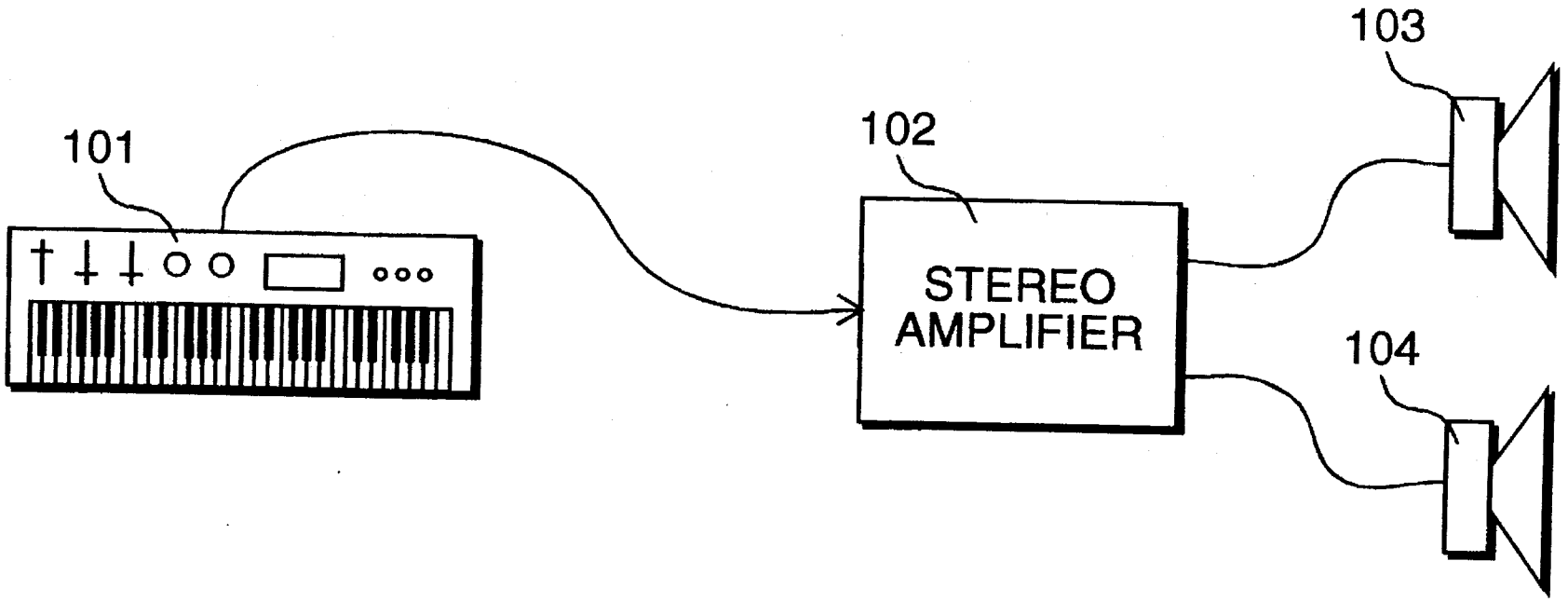
FIG. 1 shows a musical instrument arranged to generate sounds, including a musical synthesizer.

A musical synthesizer 101 is shown in FIG. 1 which supplies an audio signal to a stereo amplifier 102, which in turn supplies audio signal transducers, such as loudspeakers 103 and 104 with an amplified audio signal. The audio output from the musical synthesizer 101 may also be supplied to audio recording apparatus such as a tape recorder, such that sounds resulting from playing the synthesizer 101 may be replayed.

Figure 2:
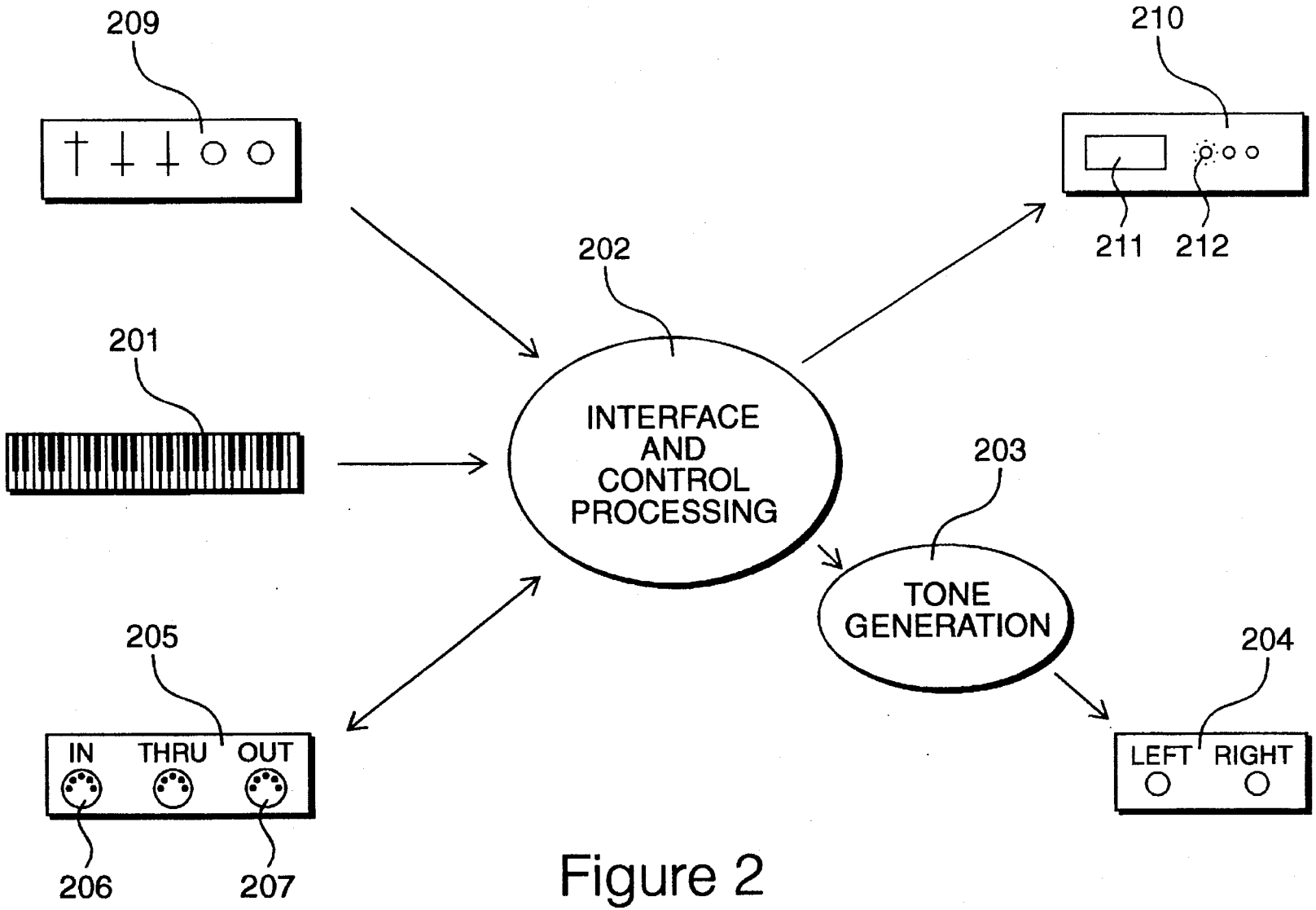
FIG. 2 details key concepts in the synthesizer shown in FIG. 1, including tone generation.

FIG. 2 details concepts operating in the musical synthesizer shown in FIG. 1. A keyboard 201 generates electrical signals in response to notes played. The electrical signals are supplied to interface and control processing circuitry 202. The electrical signals are interpreted by control processing software running on a control processor 202 to generate electrical signals suitable for controlling tone generation circuitry 203, which generates tones of an appropriate pitch, volume and timbre, in response to notes played on the keyboard 201. Analogue audio signals from the tone generation circuitry 203 are supplied to left and right audio outputs 204.

A musical instrument digital interface (MIDI) 205 is an alternative source of note information, in addition to the note information supplied from the keyboard 201. A MIDI input 206 may be connected to receive signals from another item of MIDI compatible equipment, such as a computer. Using the MIDI connection, sounds may be produced by the synthesizer without notes being played on the keyboard 201. Electrical signals generated in response to notes played on the keyboard 201 may be translated into suitable MIDI codes which may in turn be supplied to a MIDI output 207. By providing a MIDI input 206 and a MIDI output 207 on the synthesizer 101, note events resulting from a musician playing the keyboard 201 may be recorded and played back by a computer equipped with a MIDI interface and a suitable sequencing program.

Front panel controls 209 provide means for controlling the type of sounds produced when the keyboard 201 is played. The front panel controls 209 include means for selecting pre-defined characteristics of sounds from a library of sounds stored in a memory of the control processor 202. In response to manual operation of the front panel controls 209, the interface and control processing circuitry 202 may supply electrical signals to front panel display devices 210, such as an alphanumeric display 211 and light-emitting diode indicators 212. The front panel display devices 210 give an indication of the status of the synthesizer, for example displaying the library number and description of a pre-defined tone generation characteristic which is currently in operation.

The front panel controls 209 and the front panel display devices 210 in combination provide facilities for the modification of pre-defined characteristics of tone generation, the results of which may be stored in memory for later use.

Figure 3:
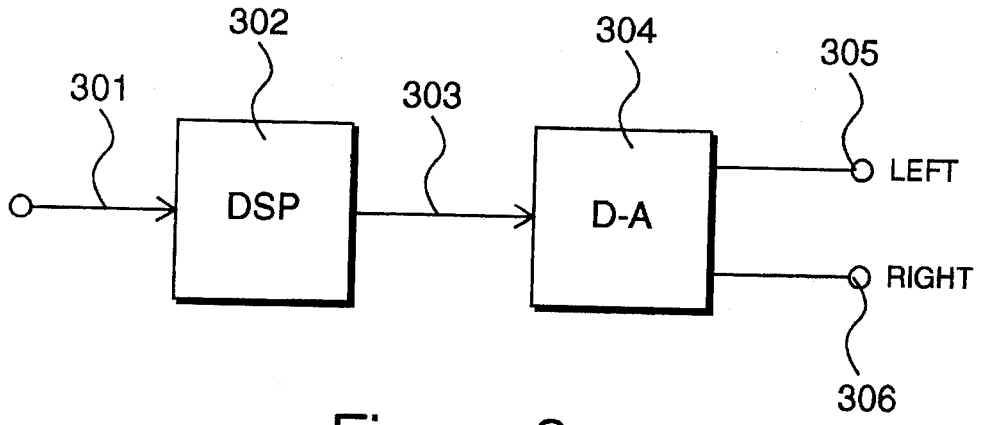
FIG. 3 shows hardware for the tone generation process shown in FIG. 2, including a digital signal processor.

The tone generation circuitry shown in FIG. 2 is detailed in FIG. 3. Electrical signals 301 are supplied by the interface and control processing circuitry 202 to a digital signal processor 302. The electrical signals 301 define tone characteristics in the form of parameters, such as frequency, pitch and volume, along with several parameters defining tone.

The digital signal processor 302 generates tones using a program, resulting in a stereo digital audio signal 303, sampled at a rate of forty-four point one thousand times a second, and having an accuracy of eighteen bits for each of the left and right channels.

The stereo digital audio signal 303 is supplied to a digital to analogue converter 304, which converts the stereo digital signals into analogue form using established high quality techniques, such as those employed in professional compact disc and digital audio tape equipment.

The digital to analogue converter in the preferred embodiment consists of an oversampling integrated circuit, for example a SM5803APT, manufactured by Nippon Precision Circuits. The SM5803 generates an over-sampled representation of the stereo digital audio signal 303, which is supplied to a high speed digital to analogue converter, such as an AD1864N-J, manufactured by Analog Devices of Norwood, Mass.

A suitable digital signal processor is the DSP56156 manufactured by Motorola of Austin, Tex. The digital signal processor 303 has additional 8K by 16 bits fast static data RAM and interface circuitry. Examples of suitable interface circuits for DSP56156 devices are provided by Motorola Inc., Digital Signal Processor Operation, Mail Drop OE314, 6501 William Cannon Drive, West Austin, Tex. 7873528598 USA.

Figure 4:
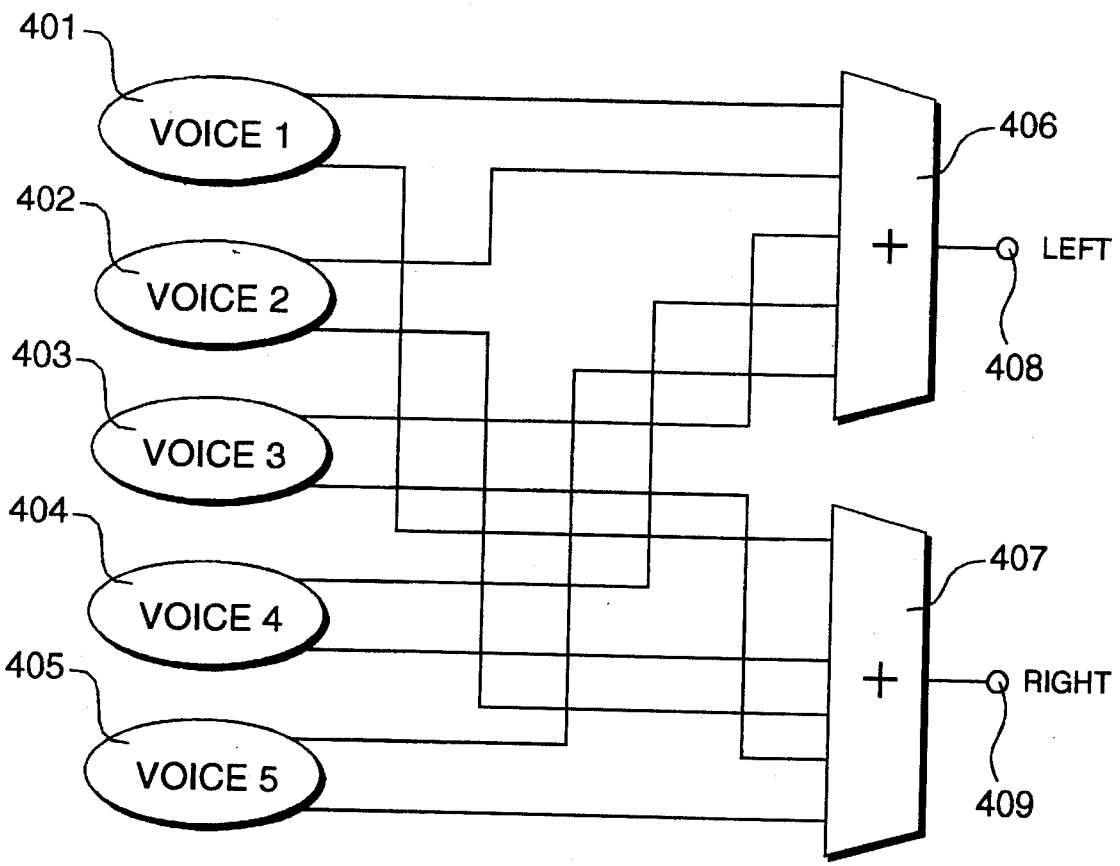
FIG. 4 shows programs operating on the digital signal processor shown in FIG. 3, including voice generators.

The overall structure of the tone generating program running on the digital signal processor is detailed in FIG. 4. Five voice generator algorithms 401 to 405 have individual left and right output signals supplied to accumulator 406 and accumulator 407 respectively. The outputs of the accumulators 406 and 407 provide the left and right summed digital audio signals of all the voice generators 401 to 405. The digital values representing left and right outputs 408 and 409 are converted into a serial form by the digital signal processor 302 before they are supplied to the digital to analogue converter 304.

Each voice generator 401 to 405 receives independent parameters defining sound characteristics. Independent control of a plurality of voices enables a musician playing the keyboard 201 to play more than one note at a time. When several notes are played on the keyboard 201 simultaneously, the control processor 202 selects one of the voices 401 to 405 for assignment to each of the notes in the order in which they are detected. Although each voice is assigned individually in response to the order in which the interface and control processing circuitry 202 detects note events, the high speed at which these operations occur ensures that a musician does not perceive the time delay between playing a note and hearing a sound, even when many notes are played.

Thus, for each note played on the keyboard 201, a set of parameters is generated by control processing software in accordance with pre-defined characteristics which have been stored in memory, or in combination with settings of controls on the front panel 209.

By providing a large number of voice generators, and by assigning the voice generators to notes as they are played, it is possible to simulate the characteristics of a keyboard instrument where each note has its own dedicated voice generator. In an alternative embodiment, several digital signal processors 302, each capable of generating several voices 401 to 405, may be used to increase the number of notes which may be played simultaneously. Outputs from several digital signal processors may be cascaded and accumulated to provide a single digital audio output 303. Techniques for cascading several digital signal processors in this way are described in data sheets for the DSP56156, available from Motorola.

Each of the voice generators 401 to 405 consists of a voice generator algorithm. The algorithm for voice generation must be completed five times within each forty-four point one thousand hertz sample cycle. Indexed addressing techniques are used to allow the same algorithm to be run five times, accessing at parameters for a different voice each time it is executed within the sample cycle. This makes it possible to store the algorithm only once in program memory resident on the digital signal processing chip, thus reducing the cost and complexity of the digital signal processor's associated circuitry.

Figure 5:
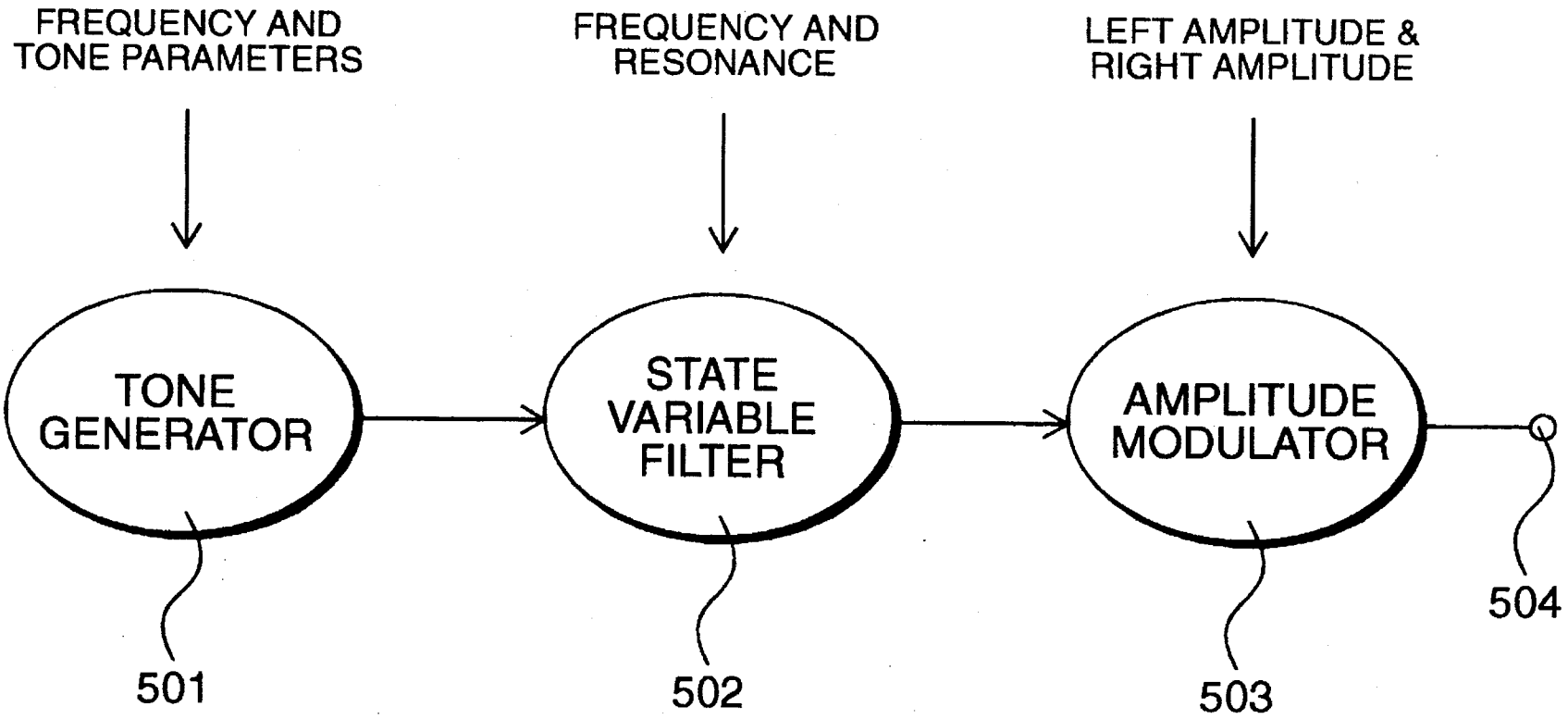
FIG. 5 details component algorithms used in a voice generator of the type shown in FIG. 4, including a tone generator.

The voice generating algorithm of the type used to generate voices 401 to 405 shown in FIG. 4 is detailed in FIG. 5. A tone generator 501 supplies audio signals to a state variable filter 502, such as a twelve decibel per octave low pass state variable filter with variable frequency and resonance (Q). This type of filter is widely known in the art, and is described in detail in chapter 14 of Musical Applications of Microprocessors by Hal Chamberlin, published by Hayden, ISBN 0-8104-5753-9.

The output of the state variable filter 502 is supplied to an amplitude modulator 503, which defines the left amplitude and the right amplitude of the stereo output 504 of the voice generator. The amplitude modulator 503 controls the overall amplitude of the sound produced by the voice generator, as well as its relative left and right amplitudes, which may be used to change the position of a voice in the stereo field. A common use of stereo positioning is when two or more voices are assigned to produce a sound for a single note and are slightly detuned, giving a stereo chorus effect.

The tone generator 501, the state variable filter 502 and the amplitude modulator 503 are sequences of program steps running on the digital signal processor 302. Parameters for each voice are transferred from the interface and control processing circuitry 202 to digital signal processor memory using the digital signal processor's host interface (described in the DSP56156 User's Manual). In this way essential parameters may be constantly updated with minimum digital signal processor overhead.

Frequency and tone parameters supplied to the tone generator 501 may change each time the tone generator algorithm is executed for a particular voice. Thus, sweeping changes in frequency and dynamic tone changes may be achieved by sending the appropriate parameters in real time from the interface and control processing circuitry 202. Similarly dynamic changes in the frequency and resonance of the state variable filter 502 may be achieved.

Amplitudes for a voice generator are updated dynamically in order to impose an amplitude "envelope" upon a particular sound. In this way the beginning and end of a sound may be defined, with appropriate attack and decay characteristics.

In the preferred embodiment a pre-defined set of envelope characteristics is stored for each sound in the sound library. The amplitude envelope is defined by four stages, which are: attack, decay, sustain and release. The attack defines the rate at which the amplitude increases after a note has been played. The release defines the rate at which the amplitude decays after a note has been released. The decay defines the rate at which a sound decays after the attack phase of the envelope has been completed and the sustain defines the level at which the decay phase ends, after which the amplitude will remain constant until the note is released.

The envelope stages are interpreted by control processing software running on the control processor 202, which supply parameters representing the instantaneous amplitude of each voice to the digital signal processor 302.

The rate at which the left and right amplitude parameters for each voice are updated is critical in the perceived quality of the audio signal. It is impractical to generate new left amplitude and right amplitude parameters for each voice at the audio sampling rate. Thus the control processor 202 generates amplitude parameters at a lower rate than the sampling rate. In the preferred embodiment, this lower rate is approximately seven hundred times per second. The amplitude modulator algorithm 503 running on the digital signal processor, interpolates between successive amplitude parameters at the audio sampling rate of forty-four point one thousand samples per second, thus providing smooth control of amplitude.

Other parameters may be updated less frequently than the full audio sampling rate. However certain of the tone parameters supplied to the tone generator 501 also require interpolation, in order that rapid changes in tone may be achieved without unpleasant distortion artifacts being added to the audio output.

Figure 6:
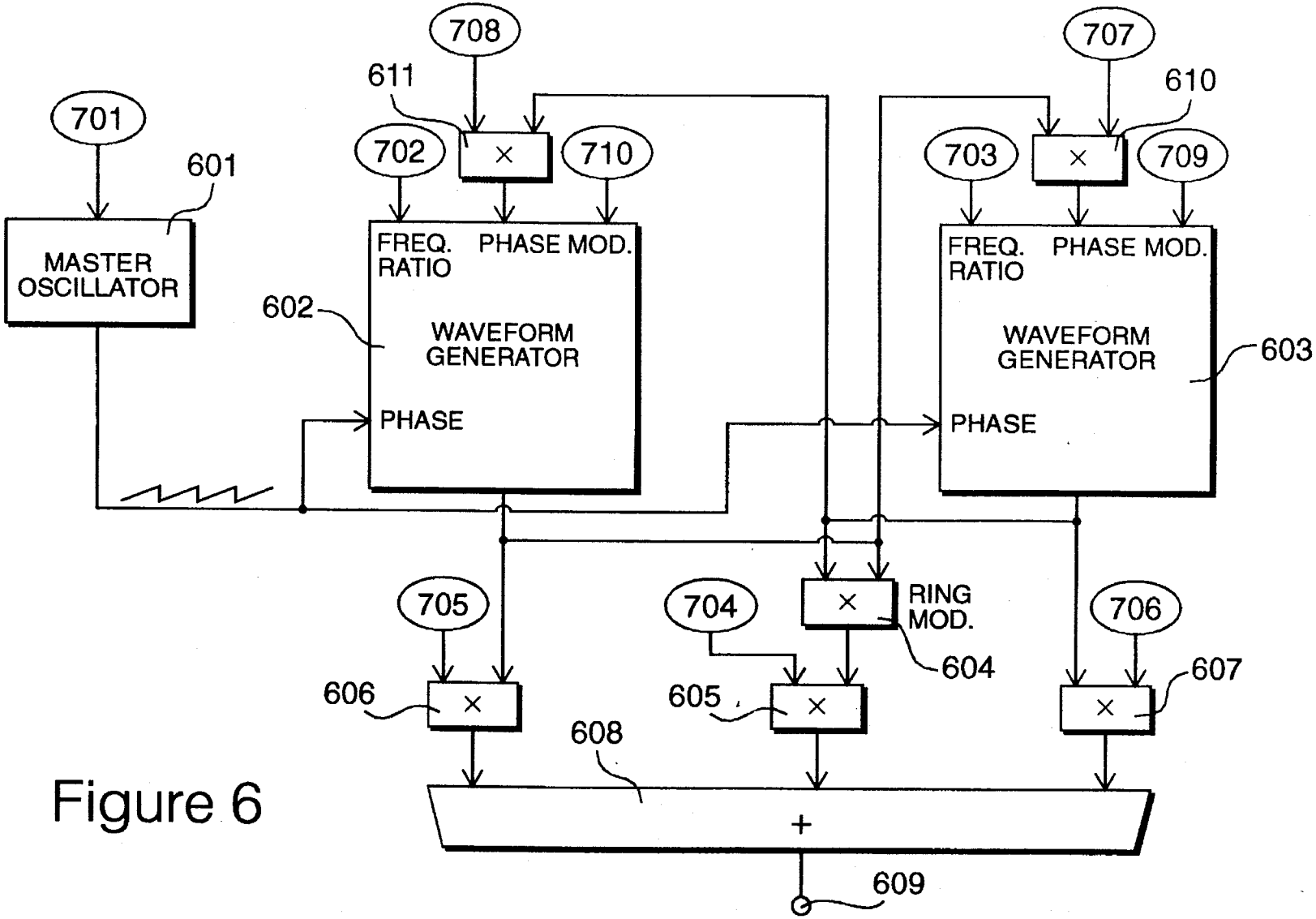
FIG. 6 details the tone generator shown in FIG. 5, including a master oscillator and waveform generators.

An arrangement for a tone generator 501 of the type shown in FIG. 5 is detailed in FIG. 6. A master oscillator 601 oscillates at a frequency defined by a master frequency parameter 701. The output from the master oscillator 601 is a sawtooth waveform represented by samples of 32 bit numbers updated at the audio sampling rate. A first waveform generator 602 generates a waveform having a fundamental frequency defined by the frequency parameter 701 supplied to the master oscillator 601 and a frequency ratio parameter 702 supplied to the waveform generator 602. A second waveform generator 603 is also supplied by the output of the master oscillator 601. A second frequency ratio parameter 703 defines the ratio of the fundamental frequency of the second waveform generator 603 to the frequency of the master oscillator 601.

The ratio of the fundamental frequency of waveform generator 602 to the fundamental frequency of waveform generator 603 is defined by the respective frequency ratio parameters 702 and 703. When the frequency ratio parameters are equal, the fundamental frequencies of both waveform generators 602 and 603 will be the same. When the frequency ratio parameter 703 of the second waveform generator 603 is twice the value of the frequency ratio parameter 702 supplied to the waveform generator 602, the fundamental frequency of waveform generator 603 will be twice that of waveform generator 602. Frequency ratios are defined according to the requirements of a particular desired tonal characteristic.

The frequency ratio parameters 702 and 703 remain constant throughout the duration of a tone. However the frequency of the master oscillator 601, defined by the frequency parameter 701, may change throughout the duration of a tone, for example to achieve pitch modulation for vibrato effects, or large sweeps in pitch.

The signal supplied by the master oscillator 601 to each of the waveform generators 602 and 603 effectively defines the phase of each waveform generator, which may be subsequently modified within the waveform generator by multiplication by a frequency ratio parameter 702 or 703. This arrangement ensures that the relative phases of the two waveform generators 602 and 603 remain constant over an indefinite period of time. This is important for the tone generation process as different relative phase offsets result in different harmonic spectra being produced by the tone generator.

The outputs from the waveform generators 602 and 603 are sixteen bit two's complement fractional values updated at the audio sampling rate. The output of the first waveform generator 602 is supplied to the first input of a multiplier 610. The second input to multiplier 610 is supplied by a phase modulation parameter 707, which is also a sixteen bit two's complement fractional number. The thirty-two bit signed fractional output generated by multiplier 610 is supplied to a phase modulation input of the second waveform generator 603. The modulation parameter 707 defines the proportion of the output from the first waveform generator 602 which is supplied to the phase modulation input of the second waveform generator 603.

When the modulation parameter 707 is zero, the proportion of the output from the first waveform generator 602 supplied to the phase modulation input of the second waveform generator 603 is zero. In this condition the second waveform generator 603 generates a fundamental frequency with no harmonics—in other words a sine wave. When the modulation parameter 707 is increased to a value other than zero, harmonics are added to the output of waveform generator 603. The modulation parameter 707 may be continuously varied throughout the duration of a tone, thus providing a means for changing the timbre of the output of the tone generator. A tone generator of this type is described by John Chowning in U.S. Pat. No. 4,018,121.

The output from waveform generator 603 is supplied to the first input of a multiplier 611. A second modulation parameter 708 is supplied to the other input of the multiplier 611. The output from multiplier 611 is supplied to a phase modulation input of waveform generator 602. Thus waveform generator 603 may be used to add harmonics to the waveform produced by waveform generator 602 in the manner that has already been described, for waveform generator 602 adds harmonics to the output of waveform generator 603.

When both modulation parameters 707 and 708 are non-zero, a proportion of the output from each waveform generator adds harmonics to the output of the other waveform generator. In this way large numbers of harmonics may be generated, even though only two waveform generators are used. Both modulation parameters 707 and 708 may be varied dynamically throughout the duration of a tone, and can be used to create dynamic changes in timbre. When both modulation parameters 707 and 708 enable a substantial proportion of either oscillators output to phase modulate the other, instability may result. Furthermore, with large phase modulation parameter values, random noise is generated.

Between the two extremes of random noise generation and sine wave production, there is a region in which useful tones are generated. By carefully balancing the levels of the modulation parameters 707 and 708, it is possible to achieve settings where the onset of instability is just audible. Under these conditions, the tone generator makes sounds similar to those made by discrete transistor analogue oscillators.

Setting the modulation parameters at the edge of instability results in very bright waveforms. It is not possible to generate tones having widely variable brightness and which retain the appealing characteristic of just audible instability. The solution to this is to supply the output of the tone generator 501 to the state variable filter 502 shown in FIG. 5. The state variable filter 502 can be used to cut or boost high frequencies selectively using the frequency and resonance controls. Thus a wide range of tones, having the appealing quality of controlled instability, may be produced.

Although the edge of instability is of particular interest to musicians working with electronics, the tone generator shown in FIG. 6 generates a wide variety of other tones, dependent on the modulation parameters 707 and 708, the frequency ratio parameters 702 and 703, and phase offset parameters 709 and 710. The relative phases of the waveform generators 602 and 603 affect the harmonics that are added to the outputs of the waveform generators. Thus it is useful to have a control for relative phase. This may be achieved by adding an offset value to the phase defined by the master oscillator 601.

The phase offset input 709 to the waveform generator 603 may be a constant value which does not change throughout the duration of a tone, but usually the value may change over cycles of several seconds in order to achieve a phasing effect. Faster cycling results in complex vibrato effects, as the instantaneous frequency of the waveform generator will be changed as a result of phase modulation by the alternating signal. This effect is particularly appealing as a means for achieving chorus effects.

In the preferred embodiment, a phase offset parameter 709 is supplied to the second waveform generator 603, and a second phase offset parameter 710 is supplied to the first waveform generator 602. The phase offset parameter 710 is equal in magnitude but opposite in sign to the phase offset parameter 709, so that the instantaneous frequency modulation of waveform generator 603, resulting from alternating phase modulation by parameter 709, is equal and opposite to the instantaneous frequency modulation of waveform generator 602 resulting from the alternating phase modulation by parameter 710. Thus the perceived pitch of the tone generator is unchanged.

The waveform generators 602 and 603 have outputs consisting of sixteen bit two's complement fractional values updated at the audio sampling rate. Outputs from the waveform generators 602 and 603 are multiplied in multiplier 604, which performs the function of a ring modulator. A ring modulator generates an output that is characterized by having frequency components which are the sum and difference of the frequency components presented at the two inputs. The phase modulation feedback of the tone generator results in rich harmonic textures, including a degree of instability which may or may not be audible. The ring modulator enhances these qualities, adding to the perceived "warmth" of the resulting sound.

The tone generator shown in FIG. 6 generates three audio signals, being: the output from waveform generator 602, the output from waveform generator 603 and the output from the ring modulator 604. The relative levels of these signals are defined by multipliers 605, 606 and 607. Respective amplitude parameters 704, 705 and 706 are supplied to the multipliers and resulting products are summed in adder 609, which provides the output 609 of the tone generator. It should be noted that the amplitude factors 704, 705 and 706 are not intended to change dynamically, and are used to define the relative levels of the three audio signals generated in the tone generator. Dynamic changes in relative amplitude have not been found to be of great importance in the generation of dynamic changes in timbre.

Thus it is possible that the multipliers 605, 606 and 607 may be implemented using simple arithmetic right shifts of the signal values in an arithmetic logic unit in the digital signal processor. However in the preferred embodiment the amplitude parameters 704, 705 and 706 are substantially continuously variable over a range of positive values from zero to 32767. Dynamic changes in volume of each voice in the synthesizer result from left amplitude and right amplitude parameters being sent to the amplitude modulator 503 which is shown in FIG. 5. Thus a constant high level of signal is supplied to the state variable filter 502 in order to minimize the effect of distortions which may occur in the filter algorithm.

The two phase modulation parameters 707 and 708 are the primary means of dynamic timbral manipulation in the tone generator (the state variable filter is considered as providing an additional means of dynamic timbral manipulation). It has been found that by maintaining a constant ratio between the two modulation parameters 707 and 708, the harmonic characteristics, although not constant in the frequency domain, nevertheless retain an identity for the human ear. In other words, by maintaining a constant ratio between the two modulation parameters 707 and 708 and changing the parameters simultaneously through a range of values, the subjective brightness of the tone produced changes without affecting the perceived harmonic character. This is similar to the way in which the harmonic character of a natural musical instrument remains constant, even though changes in brightness are accompanied by subtle changes in harmonic structures.

Furthermore, by maintaining a constant value for the product of the two parameters 707 and 708, the perceived harmonic character or color of the sound may be changed, while retaining a relatively constant brightness. Thus two relationships are used to define the modulation parameters 707 and 708. The product of the parameters is equal to perceived brightness, and the ratio of the two parameters is equal to the perceived colour. Given these relationships, it is possible to define brightness using a control on the front panel 209 of the synthesizer, and a control for color may similarly be used. Brightness and colour may be modulated by low frequency oscillators or envelope generators. Thus cyclic or automated smooth changes in brightness and colour may be achieved, and modulation parameters 707 and 708 may be derived from resulting instantaneous values for brightness and colour using the following relationships:

M1.M2=BRIGHTNESS

M1/M2=COLOUR

M2=SQRT (BRIGHTNESS/COLOUR)

M1=COLOUR.M2 where M1 is the modulation parameter 707, and M2 is the modulation parameter 708.

Although the onset of instability only occurs at a certain level of brightness, the tone generator generates appealing tones across a wide range of brightnesses, including tones where few harmonics are added. For a number of sound types it is possible that the state variable filter 502 shown in FIG. 5 may be excluded and the output 609 of the tone generator may be supplied directly to the amplitude modulator 503. In an alternative embodiment each of the three audio signals generated in the tone generator has separate amplitude multipliers for left and right audio channels, such that each of the three audio signals, from the two waveform generators 602 and 603 and the ring modulator 604 may be located at different stereo positions. If the state variable filter is excluded, dynamic amplitude modulation may be achieved by the amplitude multipliers in the tone generator and the amplitude modulator 503 shown in FIG. 5 may also be excluded.

The phase modulation offset parameters 709 and 710 are generated by the control processor 202 approximately seven hundred times a second. This rate is sufficient to achieve the required rate of change of phase for chorus effects. However, sampling quickly changing phases at such a low rate results in audible steps in phase change which are manifested as noise in the audio signal. In order to overcome this problem, the phase offset parameters supplied to the digital signal processor seven hundred times a second are linearly interpolated at the full audio sampling rate. In order to achieve linear interpolation with a minimum degree of processing, the slow parameter sampling rate (previously stated as being about seven hundred hertz) is set at a fraction of the audio sampling rate. In this case the rate chosen is a frequency of 44.1 kHz divided by 64, which is 689.0625 Hz. Given this relationship, and by deriving the rates from a common clock, linear interpolation is greatly simplified, as the value added to a parameter at each audio sample iteration is equal to the difference between the present and previous parameters received from the control processor, divided by sixty-four.

Figure 7:
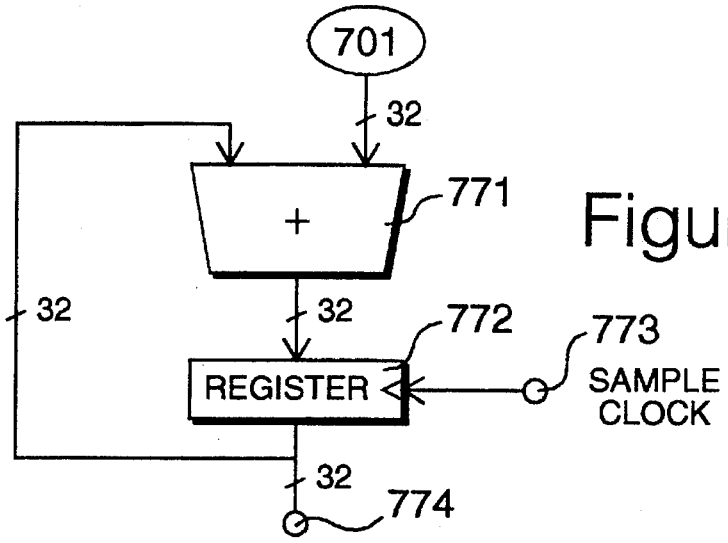
FIG. 7 details the master oscillator shown in FIG. 6.

The master oscillator 601 shown in FIG. 6 is detailed in FIG. 7. The thirty-two bit frequency parameter 701 is supplied to the first input of an adder 771. The thirty-two bit output from the adder 771 is supplied to the input of a register 772. The register 772 transfers the data presented at its input to its output on the rising edge of the sample clock 773, which has a frequency of forty-four point one thousand kilohertz. The output of the register 772 is supplied to the second input of the adder 771. Thus the contents of the register 772 are incremented by an amount defined by the frequency parameter 701 on each rising edge of the sample clock 773. The output of the register 772 is thirty-two bits wide, and forms the output of the master oscillator. When an overflow occurs in the adder 771, this is ignored.

For small values of the frequency parameter 701, the register contents increase slowly until the number resulting from the addition of the register output and the frequency parameter 701 requires more than thirty-two bits. When this occurs, the register contents return to zero or near zero and the cycle begins again. Thus the output of the register 772 consists of a digital sawtooth waveform, the frequency of which is defined by the frequency parameter 701. By using a large number of bits, such as thirty-two, to define frequency, it is possible to accurately generate the full range of pitches that are required for a musical instrument.

Figure 8:
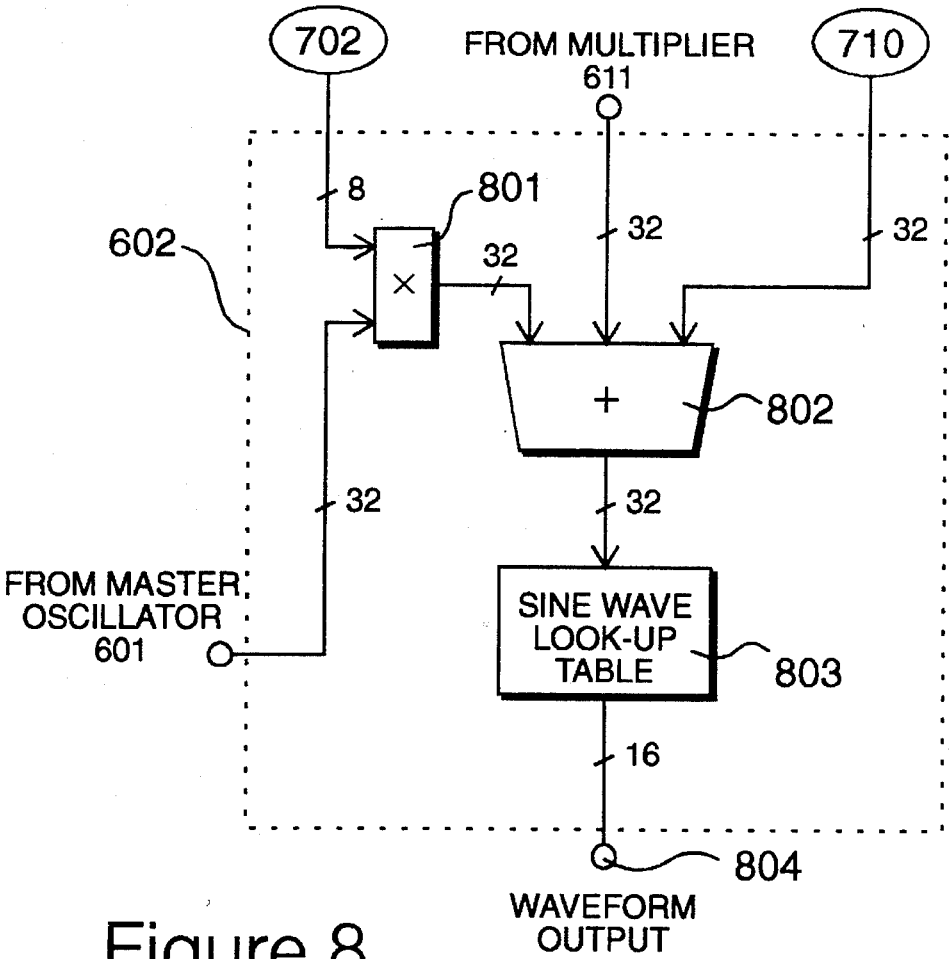
FIG. 8 details a waveform generator of the type shown in FIG. 6, including a sine wave lookup table.

The waveform generator 602 shown in FIG. 6 is detailed in FIG. 8. Both waveform generators 602 and 603 are identical. The output from the master oscillator 601 is supplied to an input of a multiplier 801. The second input of the multiplier 801 is supplied by the frequency ratio parameter 702. Usually the frequency ratio value is a small integer in the range 0 to 255 (zero values are valid—the resulting waveform has harmonics but no fundamental). Thus the multiplier 801 need not perform the time consuming task of multiplying two thirty-two bit numbers together, and in practice on a sixteen bit digital signal processor, the multiplication represented by the multiplier 801 may be achieved by two sixteen bit multiplication cycles.

The least significant thirty-two bits from the output of the multiplier 801 are supplied to a first input of an adder 802. The multiplier 611, which defines the proportion of signal supplied from the other waveform generator to phase modulate the waveform generator detailed in FIG. 8, is supplied to a second input of the adder 802. The phase offset parameter 710 is supplied to the third input of the adder 802. The least significant thirty-two bits from the output of the adder 802 supply the input of a sine wave look-up table 803. The output of the sine wave look-up table 803 forms the waveform output 804 of the waveform generator.

Figure 9A:
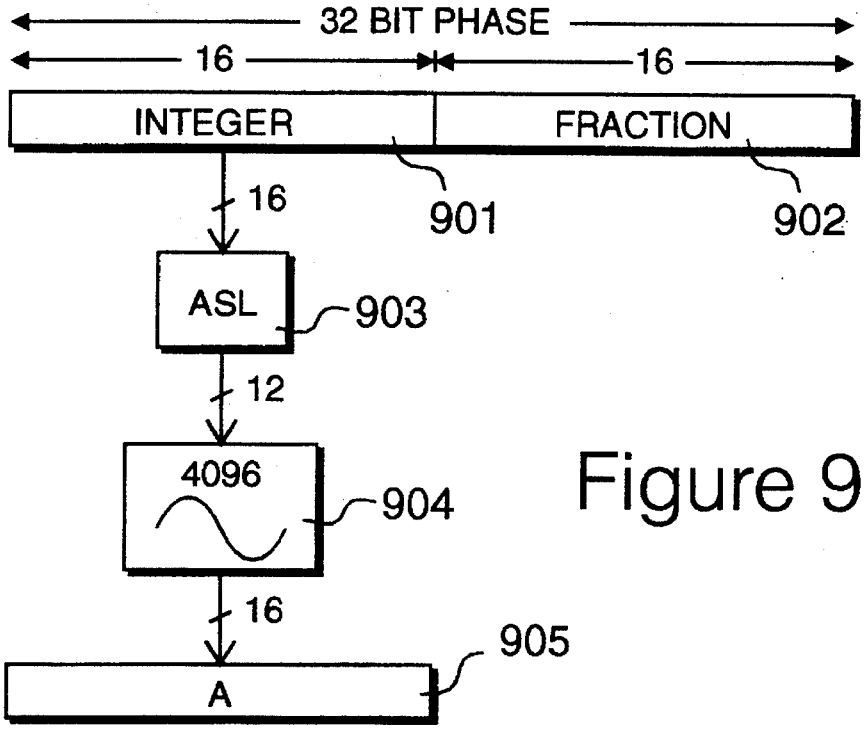
FIGS. 9A, 9B, 9C, 9D an 9E detail steps for implementing the sine wave lookup table shown in FIG. 8.

The procedures for implementing the sine wave look-up table 803 shown in FIG. 8 are detailed in FIGS. 9A to 9E. In FIG. 9A the thirty-two bit output from the adder 802 is shown having integer 901 and fraction 902 parts, each represented by sixteen bits. These two numbers define the input phase of a sine wave function. The integer phase supplies an arithmetic shift left process 903, which may shift the integer part 901 by a small number of binary positions, appending with zeros on the right. For the purposes of the initial description of the sine wave look-up table, the arithmetic shift left process 903 is considered as having no effect on the integer phase 901 (a left shift of zero bits).

The output from the arithmetic shift left process 903 is a sixteen bit number, the least significant twelve bits of which are supplied to the address input of a 4096 step sine wave memory 904. Sine wave values are represented by two's complement fractional sixteen bit values. The data value addressed in the sine wave memory 904 is supplied to a temporary register "A" 905.

Figure 9B:
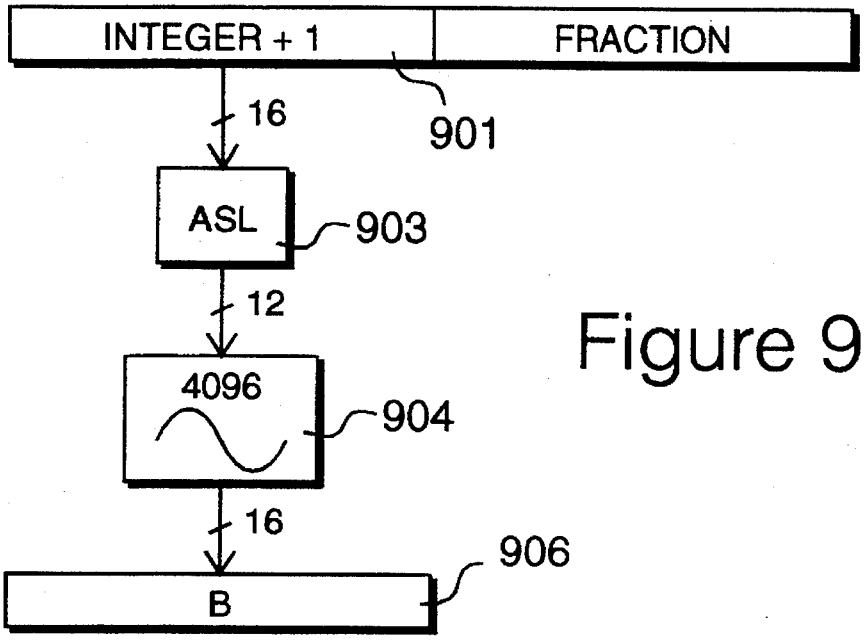

In FIG. 9B the integer part 901 of the phase output from the adder 802 has been incremented by one. This operation may be performed by an auto-incrementing addressing circuit on a digital signal processor, such as the DSP56156. The incremented integer phase 901 is supplied to the input of the arithmetic shift left process 903, which is currently considered as having no effect. The least significant twelve bits of the output from the arithmetic shift left process 903 are supplied as an input address to the sine wave memory 904, and the resulting data is supplied to a temporary register "B" 906.

Figure 9C:
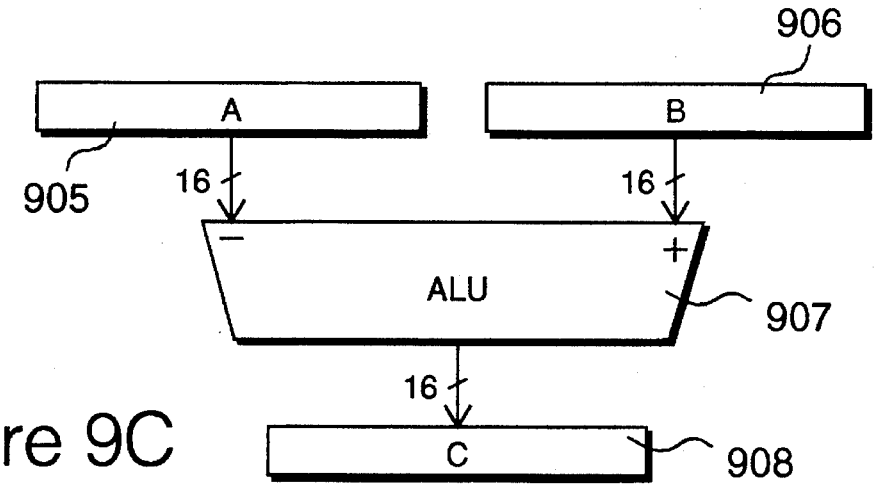

The next step of the sine wave look-up table procedure is shown in FIG. 9C. The temporary register "A" 905 and temporary register "B" 906 are supplied to inputs of an arithmetic logic unit 907. The value stored in register "A" 905 is subtracted from the value stored in the register "B" 906. The result of this subtraction is supplied to a third register "C" 908.

At this point in the generation of the sine wave value, the value stored in register "A" 905 is the value addressed by the integer part 901 of the phase. The value stored in the temporary register "C" 908 is equal to the difference between the value stored in temporary register "A" 905 and the subsequent location in the sine wave memory 904. The steps shown in FIGS. 9D and 9E perform multiplication of the value stored in register "C" 908 by the fractional part 902 of the phase value supplied by the adder 802, by the value stored in register "C" 908. This intermediate value is then added to the value in register "A" 905, thus achieving linear interpolation between successive locations in the sine wave memory 904. Thus a high precision sine wave function is performed without the need for an impractically large amount of sine wave memory.

Figure 9D:
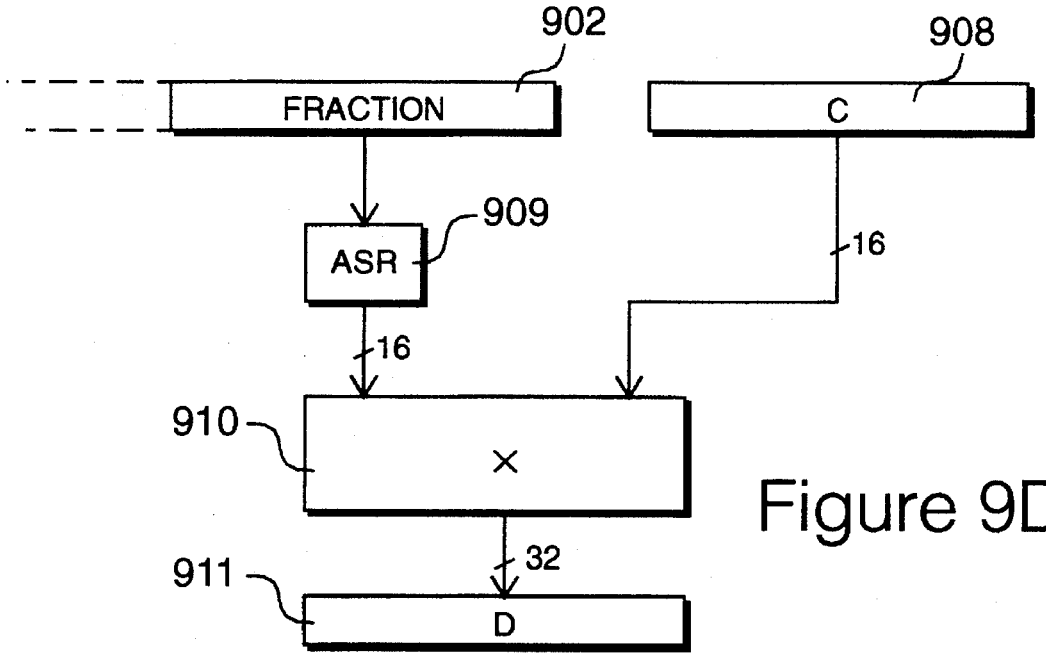

In FIG. 9D the fractional part 902 of the phase value supplied by the adder 802, is supplied to an arithmetic shift right process 909, which shifts the fractional part 902 right by one binary place, appending a zero bit on the left. This is necessary to convert the fractional part 902, which is a sixteen bit unsigned value, into a positive two's complement value. The output from the arithmetic shift right process 909 is supplied to the first input of a multiplier 910. The second input of the multiplier 910 is supplied by the output from the temporary register "C" 908. The thirty-two bit signed fractional product of this multiplication is stored in temporary register "D" 911.

Figure 9E:
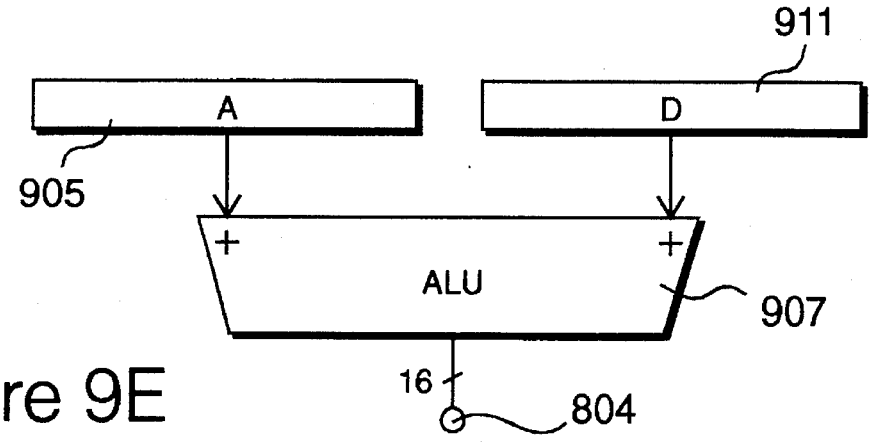

In FIG. 9E the final step for implementing the sine wave look-up table is shown. The contents of register "A" 905 are added to the contents of register "D" 911 by the arithmetic logic unit 907, and the result of this addition forms the output of the waveform generator 804.

FIGS. 9A to 9E achieve a high quality sine wave function by linear interpolation between consecutive steps in a 4096 step memory 904. Experimental results in prototypes have shown that the precision with which the sine wave function is performed affects the type of waveforms which are produced. The relationship between waveform precision and harmonic structure is not as straightforward might be expected.

Using a high precision linearly interpolated 4096 step sine wave memory 904, the tone generator algorithm shown in FIG. 6 has a strong tendency to produce waveforms having spectral characteristics similar to those produced by the human voice. This is particularly prevalent when the tone generator is supplied by low levels for modulation parameters 707 and 708 which are close to a ratio of 1:1, which do not add large numbers of harmonics to the output of the tone generator, and where the frequency ratio of the waveform generators 602 and 603 is 2:1. A proportion of the output from the ring modulator 604 is mixed with differing proportions of the outputs from both waveform generators 602 and 603 to form the output of the tone generator. By assigning three or four tone generators to each note, and detuning each tone generator by a small amount, sounds having a quality similar to that produced by a Welsh male voice choir may be produced.

When a lower precision waveform memory of 512 steps is used, different harmonic structures are generated, in particular having a tendency towards the spectral characteristics of string instruments such as cellos and violins. Both types of sound are useful in the music synthesizer, even when it is not intended to imitate a particular instrument. Thus it is useful to provide switching between different precisions of sine wave look-up table, in order to facilitate dynamic allocation of voices having different characteristics.

For example, the synthesizer may be programmed to assign vocal type sounds to the lower section of the keyboard 201, and to assign string type sounds to an upper section of the keyboard 201. Thus the same five voice generators 401 to 405 may be dynamically assigned to the most recently played note, which may be at the lower or upper end of the keyboard.

In the previous description of the look-up table, the arithmetic shift left process 903 was considered as having no effect. Thus the previous description detailed a process where the precision of the look-up table was that of a 4096 step linearly interpolated sine wave memory. When the arithmetic shift left process 903 imparts a single bit left shift, the precision of the sine wave memory 904 is reduced by a factor of 2. The arithmetic shift left process 903 shown in FIG. 9B must also shift left by the same amount in order for the look-up procedure to operate correctly. By providing a single arithmetic shift left in FIGS. 9A and 9B, the precision with which the sine wave look-up table 803 is implemented is equal to that of a linearly interpolated 2048 step sine wave memory.

An arithmetic shift left of two bits results in a precision equivalent to a linearly interpolated 1024 step sine wave memory, and an arithmetic shift left of 3 bits results in a precision equivalent to a linearly interpolated sine wave memory having 512 steps. Thus by adjusting the number of positions shifted by the arithmetic shift left process 903, it is possible to adjust the effective precision of the sine wave look-up table 803. The spectral quality resulting from the use of a particular level of waveform precision may be selected dynamically within the music synthesizer.

Referring again to the tone generator shown in FIG. 6, when the modulation parameter 708 is zero, the output of the first waveform generator 602 is a pure sine wave. If the frequency ratio of the waveform generators 602 and 603 is 2:1, and the first waveform generator 602 is phase modulating the second waveform generator 603, odd harmonics are added to the output of the second waveform generator 603. Thus, when modulation parameter 708 is zero, it is possible to generate waveforms having an odd series of harmonics. The ability to do this is important in a music synthesizer, as several naturally occurring sounds have this characteristic, which may be described as a "hollow" sound. Several musical instruments also have this quality, notably woodwind instruments.

Sounds generated by the tone generator shown in FIG. 6 rely on both modulation parameters 707 and 708 being non-zero, in order to provide a degree of controlled instability and wide dynamic timbral modification. If the output from the second waveform generator 603, containing an odd series of harmonics, is supplied to the input of the multiplier 611, and the modulation parameter 708 is non-zero, harmonics added to the output of the first waveform generator 602 will be fed back to the waveform generator 603, resulting in even harmonics being added to the output of the second waveform generator 603. Thus it is impossible using the tone generator shown in FIG. 6 to generate waveforms having only odd harmonics if both modulation parameters 707 and 708 are non-zero.

Figure 10:
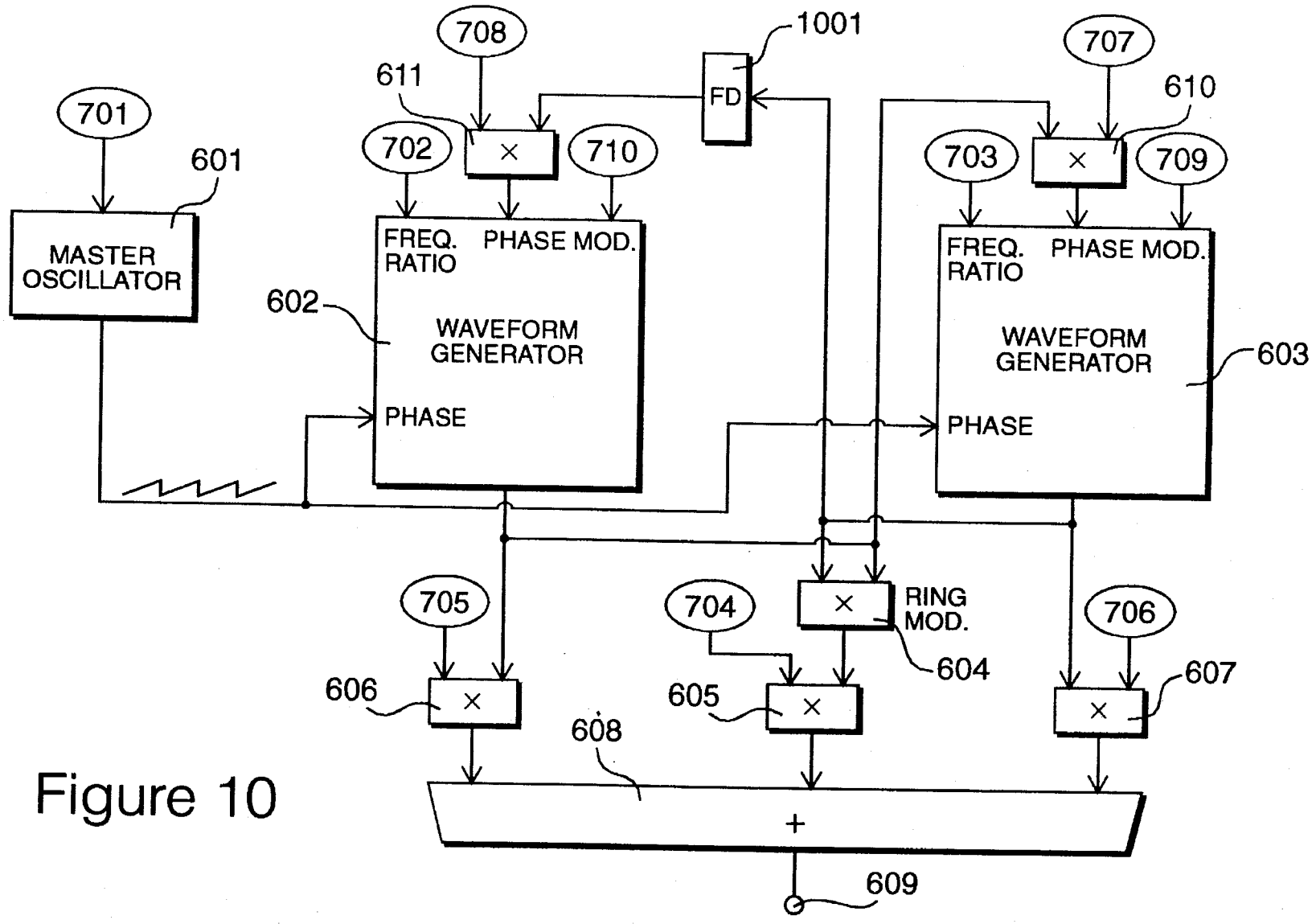
FIG. 10 details an alternative tone generator of the type shown in FIG. 5, including a frequency doubler.

A tone generator similar to the one shown in FIG. 6 is shown in FIG. 10. A frequency doubler 1001 is included in the feedback path from waveform generator 603 to waveform generator 602. The frequency doubler has the effect of doubling the frequency of all harmonic components, including the fundamental, present in the output from waveform generator 603. Thus it becomes possible to generate waveforms having only odd harmonics, even when both modulation parameters 707 and 708 are non-zero. The tone generator shown in FIG. 10 has the advantages of the tone generator shown in FIG. 6, and the ability to generate waveforms containing predominantly odd harmonics.

Figure 11:
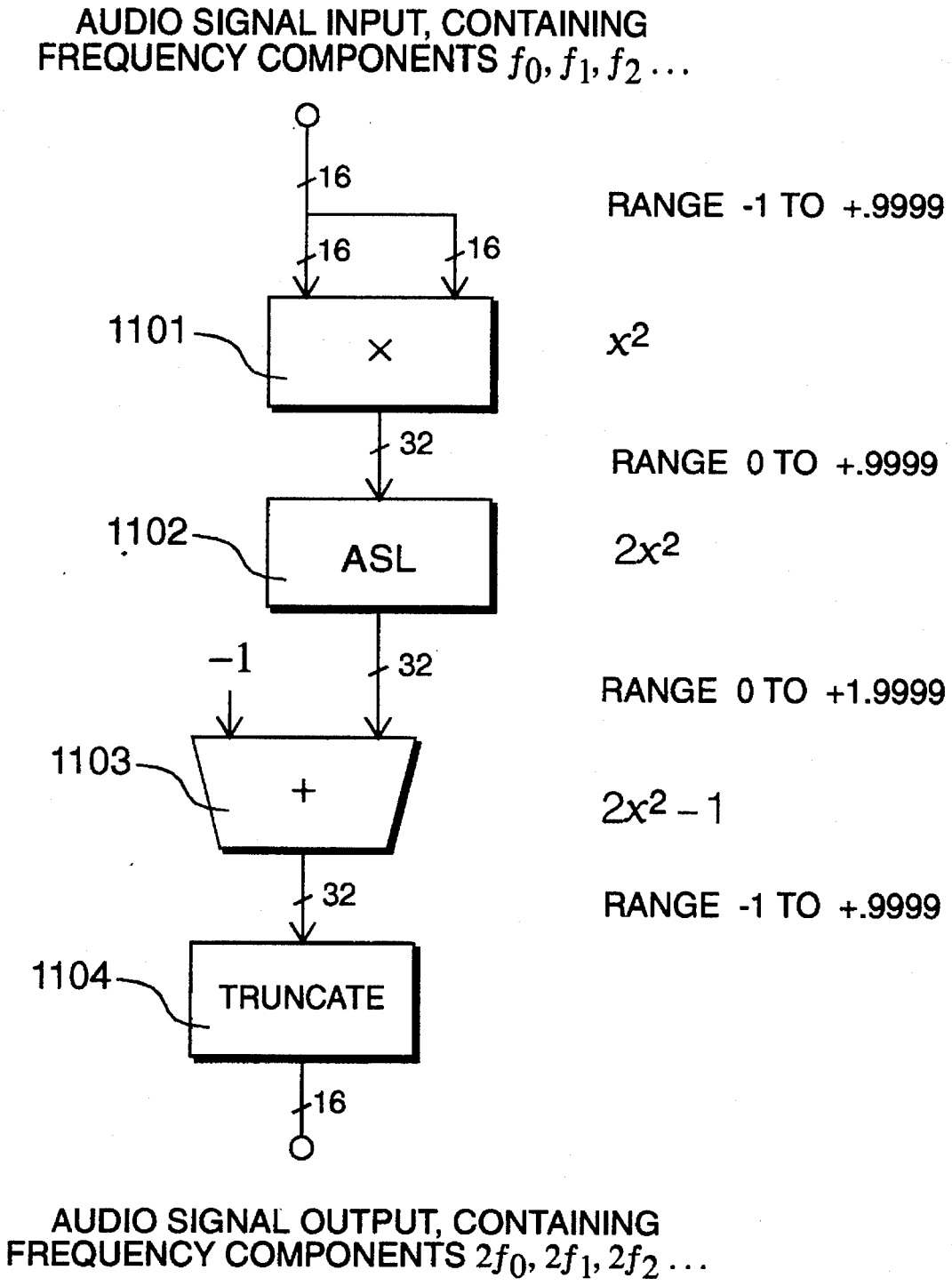
FIG. 11 details the frequency doubler shown in FIG. 10.

The frequency doubler 1001 shown in FIG. 10 is detailed in FIG. 11. A frequency doubler may be considered as an implementation of a ring modulator. A ring modulator generates an output signal containing the harmonic sums and differences of its inputs. If the two input signals are the same, only harmonic sums are generated, and thus each harmonic component presented to the input is doubled.

In FIG. 11, a first multiplier 1101 receives identical sixteen bit two's complement fractional samples at its two inputs. The thirty-two bit signed fractional output from the multiplier 1101 is characterised by having a range of values of 0 to +0.9999. Thus an offset has been introduced in the output of the multiplier 1101 as a result of squaring a bipolar audio signal.

The output from the multiplier 1101 is supplied to the input of an arithmetic shift left process 1102. This has the effect of multiplying the output of the multiplier 1101 by two, resulting in a range of values of 0 to +1.9999. The output from the arithmetic shift left process 1102 is supplied to an input of an adder 1103, which as its second input has a constant −1. Thus one is subtracted from the output of the arithmetic shift left process 1102 by adder 1103. This results in a range of values of −1 to +0.9999, which is represented by a two's complement thirty-two bit number. The desired audio signal is represented by sixteen bit samples, thus the thirty-two bit samples are truncated by process 1104 to the desired length of sixteen bits.

Thus an audio signal presented to the twin inputs of the multiplier 1101, having a range of −1 to +0.9999 is translated into an audio signal having the same precision and range of values, but which contains harmonic components having frequencies which are twice those of the respective components in the input signal.

Figure 12:
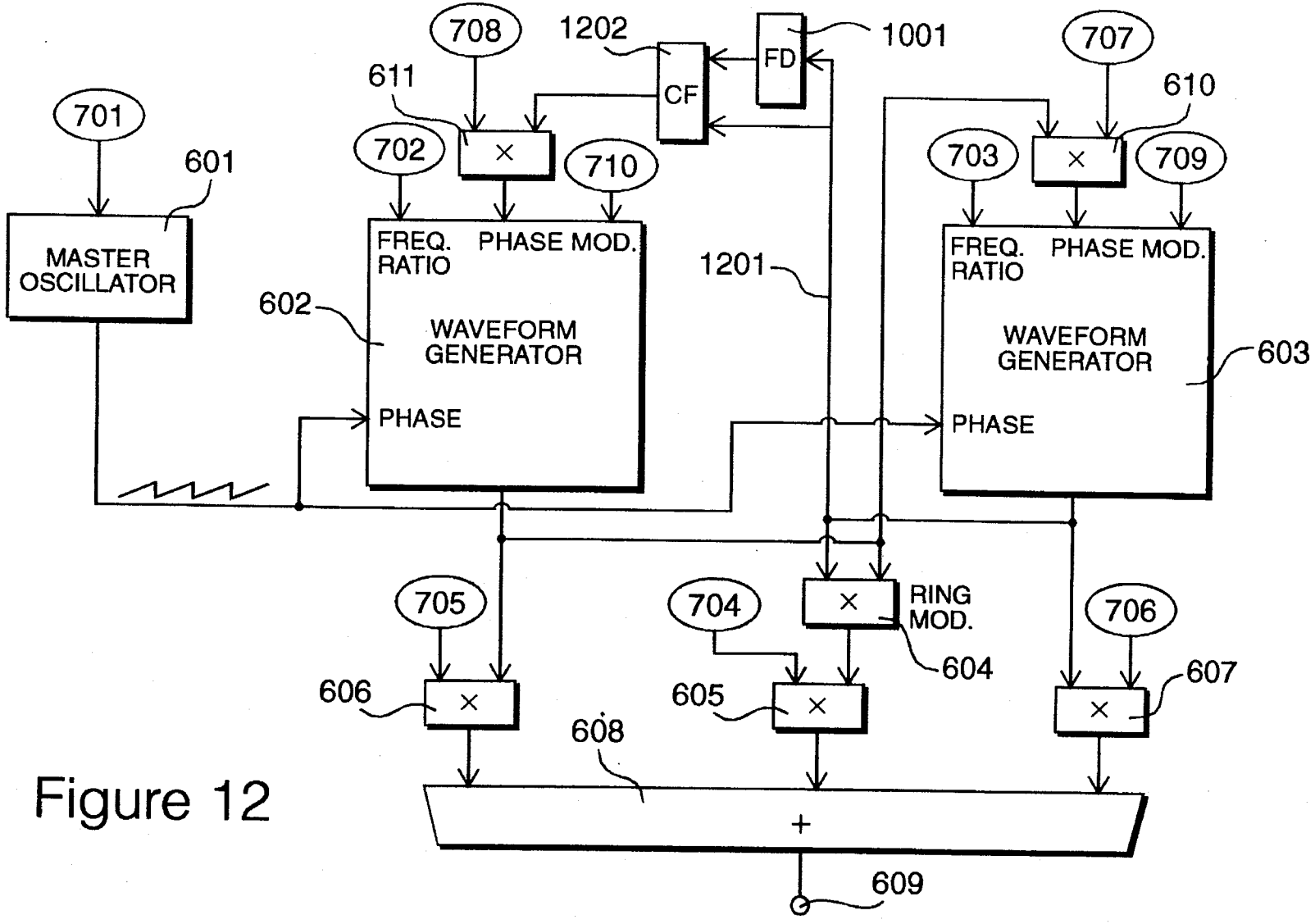
FIG. 12 details an alternative arrangement for the tone generator shown in FIG. 10, including a cross-fader.

A tone generator similar to the one shown in FIG. 10 is shown in FIG. 12. In this tone generator the output from the frequency doubler 1001 is supplied to a first input of a cross-fader 1202. The second input of the cross-fader is supplied by the direct output 1201 from the second waveform generator 603. Control data supplied regularly to the cross-fader 1202 enables dynamic changes between the type of algorithm shown in FIG. 10 and the type of algorithm shown in FIG. 6. Thus it is possible to dynamically adjust the ratio of odd harmonics to even harmonics present in the tone generator output.

Figure 13:
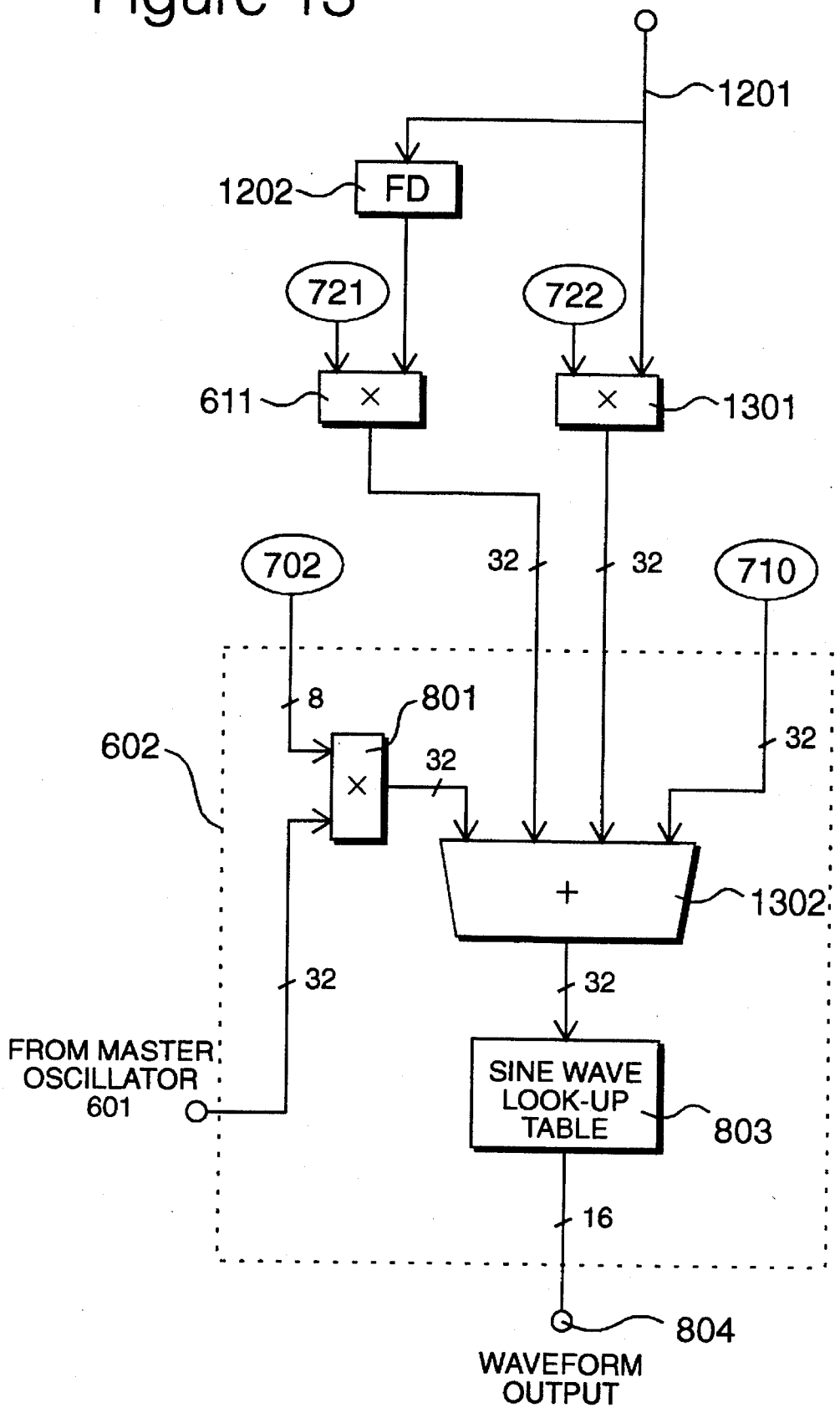
FIG. 13 details the cross-fader shown in FIG. 12.

An implementation of the cross-fader 1202 shown in FIG. 12 is detailed in FIG. 13. The waveform generator 602, originally detailed in FIG. 8, is shown having a modified adder 1302, which accepts an additional phase input. The output 1201 from the waveform generator 603 is supplied to a first input of a multiplier 1301 which receives at its second input a modulation parameter 722. The output from multiplier 1301 is supplied to an input of the modified adder 1302. The output from the frequency doubler 1202 is supplied to an input of the multiplier 611, which receives at its other input a modulation parameter 721. The output from the multiplier 611 is supplied to an input of the modified adder 1302.

The modulation parameter 721 defines the proportion of the output from the frequency doubler 1202 supplied to phase modulate the waveform generator 602. The modulation parameter 722 defines the proportion of the direct signal 1201 from the waveform generator 603 supplied to phase modulate the waveform generator 602. Thus by adjusting the relative values of the two modulation parameters 721 and 722, it is possible to adjust the type of harmonics which are added to the tone generator output. A pure cross-fading function is achieved when the value of the parameter 722 changes in the opposite sense to the modulation parameter 721. When this is the case, a high value of the parameter 722 may be accompanied by a low value of the parameter 721. It is possible for the two parameters to be equal or, alternatively, a high value of parameter 721 may be accompanied by a low value of parameter 722. The sum of the two parameters defines the overall phase modulation depth of waveform generator 602, while the ratio of the two parameters defines the type of harmonics which are generated by the tone generator.

Figure 14:
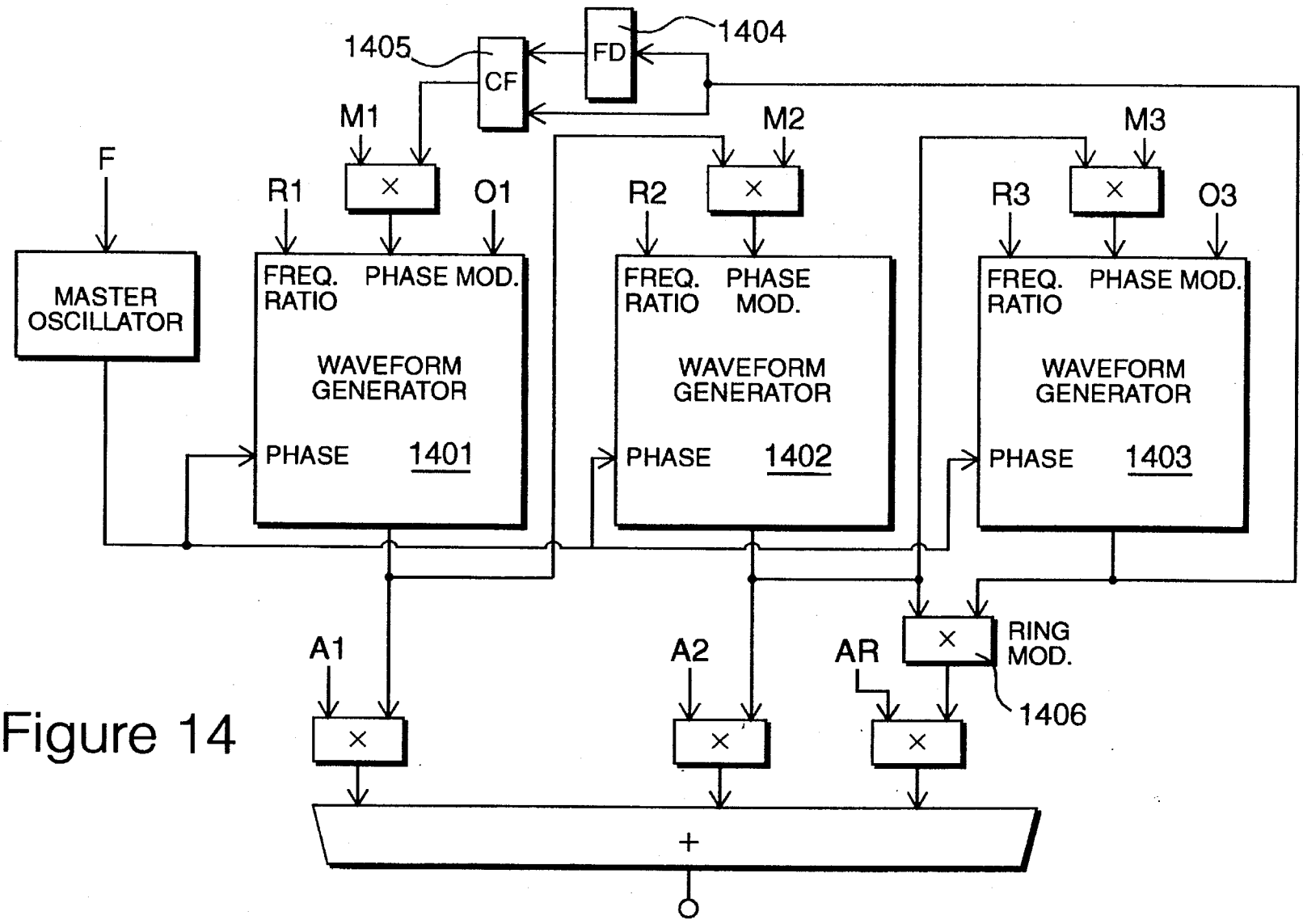
FIG. 14 shows an alternative arrangement for a tone generator of the type shown in FIG. 12.

The tone generator shown in FIG. 12 may be modified to include three waveform generators, as shown in FIG. 14. A waveform generator 1401 is able to phase modulate a second waveform generator 1402, which is able to phase modulate a third waveform generator 1403. A frequency doubler 1404 supplies a first input of a cross-fader 1405, and the second input of the cross-fader 1405 is supplied directly by the output from waveform generator 1403. The output from the cross-fader 1405 is able to phase modulate the first waveform generator 1401. The outputs from waveform generators 1402 and 1403 are supplied to a ring modulator 1406. Three outputs are used, consisting of the outputs from waveform generators 1401 and 1402, and the output from the ring modulator 1406. The output from the waveform generator 1403 does not directly contribute to the output of the tone generator.

In an alternative embodiment, the output from the waveform generator 1403 may be used in addition to or as a replacement for one of the other three outputs. The tone generator shown in FIG. 14 is capable of producing a wider variety of tones than the tone generators which use only two waveform generators. However there are certain types of sound which may be produced by the two waveform generator type of algorithm, which cannot be achieved using the three waveform generator type of algorithm shown in FIG. 14.

Thus a preferred embodiment includes programs for implementing a plurality of possible tone generator topologies, which may be dynamically switched in real time to facilitate the mapping of different parts of the keyboard 201 to different sounds produced by different tone generators.

Figure 15:
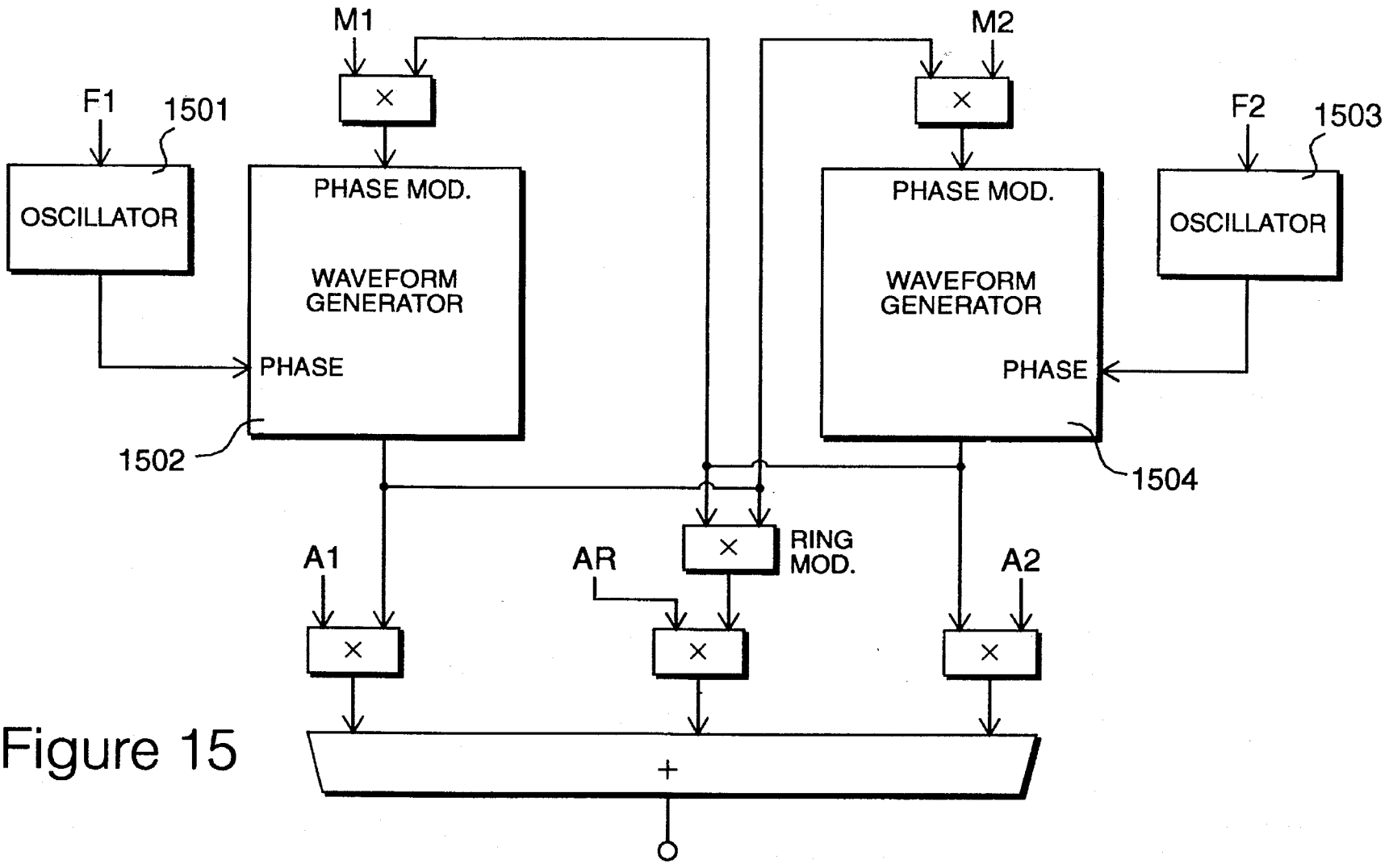
FIG. 15 shows an alternative arrangement for a tone generator of the type shown in FIG. 5.

An additional alternative tone generator is shown in FIG. 15. A first master oscillator 1501 supplies a phase signal to a first waveform generator 1502, and a second master oscillator 1503 supplies a phase signal to a second waveform generator 1504. In this tone generator the relative phases of the two waveform generators 1502 and 1504 are not fixed, and the frequency ratios are defined by the frequency parameters supplied to the two master oscillators 1501 and 1503. The advantage of this arrangement is that non-integer frequency ratios may be used, resulting in bell-like sounds.

Furthermore it is possible to sweep the frequency of one of the waveform generators across a wide range of values, while the frequency of the other waveform generator remains constant. In this way it is possible to sweep dynamically through a large range of integer and non-integer values of frequency ratio, resulting in extremely dramatic changes in tone. These effects are not particularly useful for pitched notes, but they can be used to provide a wide range of non-harmonic or percussive special effects.

It will be appreciated that the descriptions of the mathematical procedures for implementing the tone generators are shown in a form that may be readily translated into specific assembly language or machine code steps for digital signal processing hardware.

In an alternative embodiment, a semi-custom or custom digital signal processor chip is used to perform the functions described at greater speed or greater cost-effectiveness than a general purpose digital signal processor. Several such custom digital signal processor chips may be cascaded and controlled by a master processor, which may also be a digital signal processor. Thus a musician may play a large number of notes simultaneously, or alternatively have the facility to stack and detune several voice generators on each note, while still retaining the ability to play many notes simultaneously.

It is possible that future developments in silicon hardware may make it unnecessary to design a custom chip. In particular the Texas Instruments TMS320C80 is a new design which includes four high speed digital signal processors and a master processor on the same chip. Thus, in the future, it may be possible to combine the functions of the control processor and a large number of voice generators within a single integrated circuit.

What is claim is:

1. A method of electronically synthesising musical tones, comprising the steps of:

generating a plurality of waveforms using waveform generating units having respective inputs and outputs, such that each of said inputs is arranged to receive a signal for phase modulating the waveform generated by its respective waveform generating unit;

supplying a proportion of an output from a first waveform generating unit to an input of a second waveform generating unit;

supplying a proportion of an output from said second waveform generating unit to an input of another waveform unit, whereby said plurality of waveform generating units form a chain, such that the input of said first waveform generating unit receives an output from the final waveform generating unit of said chain, thereby providing a degree of recursion; and supplying a plurality of said outputs to a processing means to produce a tone including harmonic sums and differences of frequencies produced by said recursion.

2. A method according to claim 1, further comprising steps of controlling frequencies of waveforms generated by said plurality of said waveform generating units by a master oscillating means.

3. A method according to claim 1, further comprising steps of adjusting a relative phase of one of said waveform generating units.

4. A method according to claim 1, further comprising steps of defining a frequency ratio between said plurality of waveform generating units.

5. A method according to claim 1, further comprising steps of adjusting the proportion of one of said outputs supplied to one of said inputs, while maintaining the ratio between proportions of all of said outputs supplied to respective inputs substantially constant.

6. A method of tone generation comprising the steps of:

deriving digital representations of recursively generated output signals by a process of interpolating between values read from storage means; and adjusting the effective number of said values read from said storage means to change the effective accuracy, and thereby select a particular harmonic characteristic for the generated tone.

7. A method according to claim 6, wherein said values stored in said storage means represent a waveform;

reading said values at a first selected resolution, wherein all of said values are readable; and a second resolution wherein only an evenly spaced subset of said stored values are readable.

8. A method of electronically synthesising a musical tone, comprising steps of:

generating a waveform using a first waveform generating unit having an input and an output;

supplying said output to an input of a processing means, wherein said processing means includes frequency doubling means; and supplying a proportion of an output of said processing means to said input of said first waveform generating unit.

9. A method according to claim 8, wherein said processing means includes additional waveform generating means;

a proportion of the output from said first waveform generating unit is supplied to an input of said additional waveform generating means; and an output from said additional waveform generating means is supplied to an input of said frequency doubling means.

10. A method according to claim 9, wherein said additional waveform generating means includes a plurality of serially connected additional waveform generating units.

11. Apparatus for electronically synthesising musical tones, comprising means for:

generating a plurality of waveforms using waveform generating units having respective inputs and outputs, such that each of said inputs is arranged to receive a signal for phase modulating the waveform generated by its respective waveform generating unit;

supplying a proportion of an output from a first waveform generating unit to an input of a second waveform generating unit;

supplying a proportion of an output from said second waveform generating unit to an input of another waveform generating unit, whereby said plurality of waveform generating units form a chain, such that the input of said first waveform generating unit receives an output from the final waveform generating unit of said chain, thereby providing a degree of recursion; and supplying a plurality of said outputs to a processing means to produce a tone including harmonic sums and differences of frequencies produced by said recursion.

12. Apparatus according to claim 11, including master oscillating means for controlling frequencies of waveforms generated by said plurality of said waveform generating units.

13. Apparatus according to claim 11, including means for adding a phase offset to one of said waveform generating units.

14. Apparatus according to claim 11, including means for defining a frequency ratio between said plurality of waveform generating units.

15. Apparatus according to claim 11, further comprising means for adjusting the proportion of one of said outputs supplied to one of said inputs, while maintaining the ratio between proportions of all of said outputs supplied to respective inputs substantially constant.

16. An apparatus for generating musical tones comprising:

means for deriving digital representations of recursively generated output signals by interpolating between values read from a storage means; and means for adjusting the effective number of said values read from said storage means such that the effective accuracy is changeable, thus enabling a particular harmonic characteristic for the generated tone to be selected.

17. Apparatus according to claim 16, wherein the values stored in said storage means represent a waveform; including selecting means such that:

at a first selected resolution all of said values are readable; and at a second selected resolution only an evenly spaced subset of said stored values are readable.

18. Apparatus for electronically synthesising a musical tone, comprising:

a first waveform generating means having an input and an output;

a processing means including frequency doubling means;

first supplying means for supplying said output of said first generating means to an input of said processing means; and second supplying means for supplying a proportion of an output of said processing means to said input of said first waveform generating unit.

19. Apparatus according to claim 18, further comprising:

third supplying means for supplying the output from said first waveform generating means to an input of a second waveform generating means; and fourth supplying means for supplying a proportion of an output from said second waveform generating means to an input of said frequency doubling means of said processing means.

20. Apparatus according to claim 19, wherein said second waveform generating means includes a plurality of serially connected additional waveform generating units.

* * * * *